US006686528B1

(12) United States Patent
Dicken

(10) Patent No.: US 6,686,528 B1
(45) Date of Patent: Feb. 3, 2004

(54) CYMBAL DAMPER

(76) Inventor: Michael Dicken, 1911 Jenkintown Rd., Jenkintown, PA (US) 19046

( * ) Notice: Subject to any disclaimer, the term of this patent is extended or adjusted under 35 U.S.C. 154(b) by 0 days.

(21) Appl. No.: 10/267,340

(22) Filed: Oct. 9, 2002

(51) Int. Cl.[7] ..... E01D 13/02
(52) U.S. Cl. ..... 84/422.3; 84/422.1; 84/422.2
(58) Field of Search ..... 84/422.1, 422.2, 84/422.3, 420

(56) References Cited

U.S. PATENT DOCUMENTS 1,979,633 A * 11/1934 Miessner
2,587,236 A * 2/1952 Side ..... 200/90
2,765,696 A * 10/1956 Hughes ..... 84/405
3,009,438 A * 11/1961 Kennedy et al. ..... 116/137
3,167,995 A * 2/1965 LaLonde ..... 84/421
3,688,627 A * 9/1972 Peterson ..... 84/171
4,216,696 A * 8/1980 Alexis, Jr. ..... 84/422.3
4,619,178 A * 10/1986 Kondoh ..... 84/410
4,667,562 A * 5/1987 Lee ..... 84/422
4,776,254 A * 10/1988 Cruz ..... 84/422.1
5,959,227 A * 9/1999 Shapiro ..... 84/411 M
5,986,197 A * 11/1999 Allen ..... 84/411 M
6,239,343 B1 5/2001 Hoshino ..... 84/422.3

* cited by examiner

*Primary Examiner*—Kimberly Lockett
(74) *Attorney, Agent, or Firm*—Elman Technology Law, P.C.; Gerry J. Elman

(57) ABSTRACT

A damper or muffler assembly for a cymbal uses a remote pedal for damping. A bicycle type caliper brake assembly is mounted to post mounting hardware for a drum set, so that the caliper can be attached to a supporting post for the cymbal. The caliper closes into a clamping position so as to absorb sound-producing vibration or completely render the cymbal immovable, according to the degree of clamping force applied. The caliper can be mounted to free-standing cymbals, high hat cymbals and other types of cymbals, and is particularly useful for use with type of cymbal used in combination with a set of drums and played by striking the cymbal with a drumstick.

3 Claims, 4 Drawing Sheets

CYMBAL DAMPER

BACKGROUND OF THE INVENTION

1. Field of the Invention

This invention relates to a damper or muffler assembly of the type used to dampen or muffle the sound issuing from a cymbal when it is struck with a drumstick or like instrument in the normal fashion wherein a vibration and movement of the cymbal is reduced or stopped, by a clamping assembly thereby serving to dampen the sound issuing therefrom.

2. Description of the Prior Art

In the playing of percussion instruments, more specifically a drum set, the use of outstanding cymbals is quite common. The cymbals, of course, are played similar to the drums in that they are struck repeatedly by a drumstick or like instrument specifically designed to render from the cymbals, when struck, certain sounds. In certain situations, it is more desirable from a musician's stand-point to effectively muffle or dampen the sound issuing from the cymbal. Typically, in the prior art, this is accomplished by stopping the vibrational movement of the cymbal either by the hand of the player or alternately by some type of mechanical, electrical or like manipulative device serving to engage the moving cymbal and absorb the vibration therefrom.

In assembling and modifying musical instruments, it is often desired to maintain the original manufacturer's design to an extent that sound is generally unaffected. If possible, it is also desired that the modification not affect the instrument in any meaningful way except when the modification is directly employed. In the case of cymbals, this means that the mounting arrangement and suspension of the cymbal not be affected. In the case of a damping mechanism, it is also desired that the damping mechanism not affect the sound or mechanism for playing, or for that matter damping of the cymbal, unless it is desired to perform damping with the mechanism.

It is further desired that a modification be provided which is easy to install, and which does not require modification of the instrument itself. Ideally, the modification should be such that if the user of the instrument wants, the modification can be easily removed with the instrument being unchanged from having been previously modified.

U.S. Pat. No. 4,776,254, to Cruz, describes an electrical switch mechanism which can be used to move an external damper assembly. U.S. Pat. No. 4,216,696, to Alexis, Jr., describes a cymbal stand and assembly with a series of pedal-activated rods. The rods operate a striker and a damper. U.S. Pat. No. 3,688,627, to Peterson, discloses an electrically operated rhythm instrument which includes an electronically controlled damper which engages but does not physically grip a cymbal thereby dampening the vibration and the attendant sound issuing therefrom. It should be noted that the dampener structure associated with this device is totally electronically controlled and in effect is part of an organ mechanism. U.S. Pat. No. 2,484,745, to Rowe, is directed to a damper operating mechanism for electric percussion instruments designed for use with an instrument including a plurality of horizontally arranged resonant bars of graduated dimension in order to obtain the desired tone when the bar is struck by a striker. A dampener structure is associated therewith.

Other related prior art devices are demonstrated in the following U.S. patents: Hoshino, U.S. Pat. No. 6,239,343; Lee, U.S. Pat. No. 4,667,562; Miessner, U.S. Pat. No. 1,979,633; Kennedy et al., U.S. Pat. No. 3,009,438; Kondoh, U.S. Pat. No. 4,619,178; Londe, U.S. Pat. No. 3,167,995; Hughes, U.S. Pat. No. 2,765,696; Side, U.S. Pat. No. 2,587,236.

Accordingly, while the above set forth patents and the general knowledge of the prior art demonstrates that dampening cymbals to accomplish certain sounds by mechanical and electrical means is generally known in the art, none of the devices represented in the aforementioned patents or known by the inventor herein relate to a specific device which conveniently allows pedal damping by use of hardware mounted external to the cymbal.

SUMMARY OF THE INVENTION

The present invention relates to a damper assembly of the type mounted adjacent and in operative relation to an up-standing cymbal. The cymbal in question may take a variety of forms and the subject damper assembly of the present invention may be used with any number of a variety of type of cymbal structures. Typically, the cymbal is an outstanding cymbal of the type used with a drum set and which is "played" by being struck repeatedly with a drumstick or other applicable, conventional instrument.

The damper assembly of the present invention includes a clamp assembly supported by a plurality of interconnected linkage members or arms specifically structured and disposed to allow positioning of the clamp assembly into an operative position relative to the cymbal.

The linkage supports a bicycle-type brake caliper into a position which permits the caliper to grip the cymbal near the edge of the cymbal. The linkage is attached to a supporting mechanism for the cymbal so that the caliper can be maintained in a desired position with respect to the cymbal. Activation of the caliper is available by means of a foot pedal which operates a bicycle brake cable, so that the caliper can be clamped with a degree of pressure as selected by the musician. A side pull or center pull design caliper may be used.

In one embodiment, the customary brake blocks used with the brake caliper are replaced with felt pads. The felt pads are optionally mounted on mounting springs. This provides the musician with a wide range of damping, as controlled by foot position and as varied by compression of the mounting spring and compression of the felt.

When the clamp is brought into a clamped position from a non-clamped position the pads engage opposite surfaces or side of the cymbal, concurrently, such that the cymbal is clamped therebetween. If sufficient pressure is applied, the cymbal is held relatively immovably. In such a position, the vibration of the cymbal is dampened and the attendant sound issuing therefrom is muffled. The duration of time and delay are directly controlled by the musician by working the pedal.

DESCRIPTION OF PREFERRED EMBODIMENTS

Figure 1:
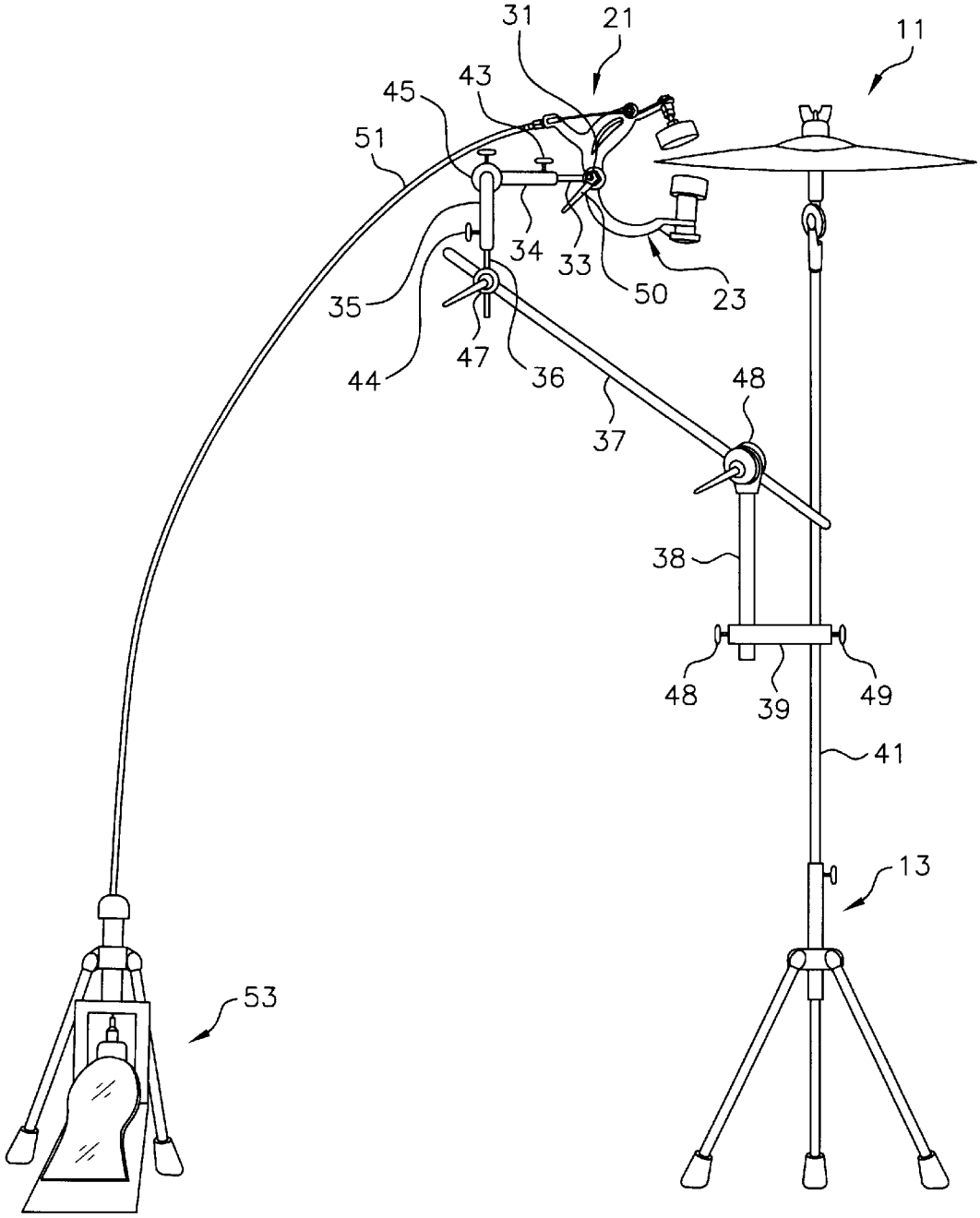
FIG. 1 is an arrangement for a cymbal damper in accordance with the present invention.

As shown in FIG. 1, the present invention is mounted to a cymbal, shown as a single cymbal 11, which includes a cymbal disk 12. Other types of cymbals such as crash, ride, splash, china, sizzle, and suspended symphonic type cymbals can be used, provided that the inventive device can be mounted adjacent the cymbal. In addition, multiple disk cymbals, such as high hat cymbals can be used, and it is not necessary that the cymbal be aligned horizontally in the manner of a crash cymbal or a ride cymbal. The cymbal 11 is typically of the type mounted on a conventional stand 13 or like supporting member and is operated or "played" by being repeatedly struck by a drumstick or in another manner which results in the customary sound.

Figure 2:
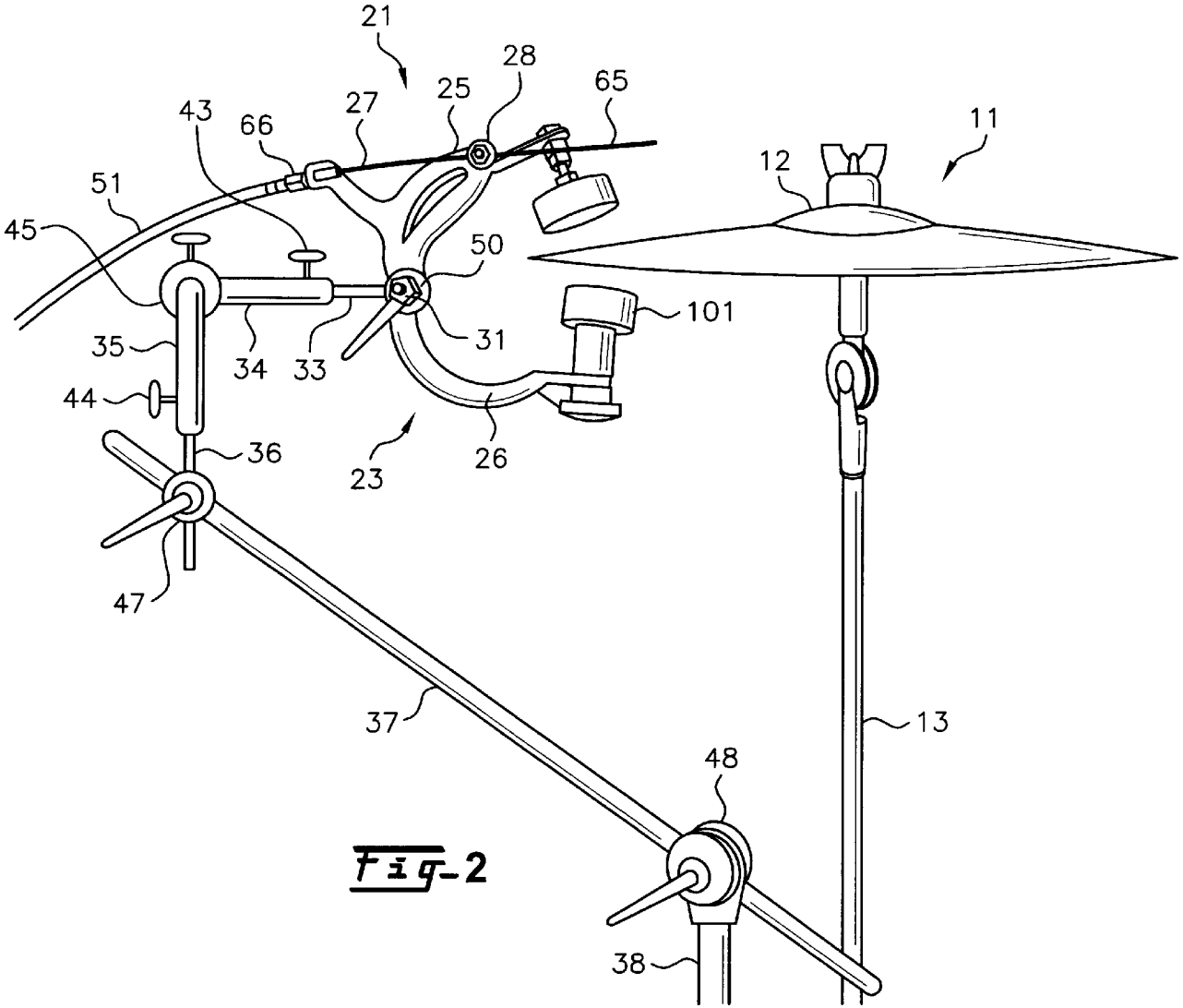
FIG. 2 is a side view of a damper assembly used with an exemplary embodiment of the invention.

FIG. 2 is a more detailed view of a damper assembly 21 used with the invention. Referring to FIGS. 1 and 2, the damper assembly 21 includes a brake caliper mechanism 23 which consists of two arms 25, 26, are connected to a cable 27 with a cable pull 28. Normally the cable pull 28 is used as the actuation mechanism for the caliper mechanism 23 in the manner of a side pull bicycle brake, which provides the advantage that the caliper mechanism 23 includes a cable stop which supports a cable cover, which will be described later. Alternatively, it is possible to use a center pull brake, provided that a cable stop can be provided to restrain the cable cover.

The caliper mechanism 23 includes a mounting bolt 31 which supports the caliper mechanism on a positioning rods 33–39. The positioning rods 33–39 include caliper positioning post 33, caliper positioning sleeve 34, vertical rods 35, 36, and extension rod 37. Also included are vertical support 38 and horizontal support 39. The horizontal support 39 is in turn supported onto a support post 41, which is part of the stand 13 for the cymbal 11.

The caliper the caliper positioning sleeve 34 and vertical rod 35 have a clamp bolts 43, 44 which, when loosened permit the positioning of post 33 and rod 36, respectively, and which tighten to secure the respective parts 33, 36. A swivel ball and socket arrangement 45 is used to allow two axis adjustment of the caliper positioning post and sleeve 33, 34 with respect to the vertical rods 35, 36. Swivel clamps 44, 47 are used to attach ends of extension rod 37, and provides single axis adjustment. Horizontal support 39 is clamped to support post 41 and clamps vertical support 38 with a pair of post clamps 48, 49.

The mounting bolt 31 for the caliper 23 receives a clamp 50. Clamp 50 is similar in construction to clamps 47, 48 and permit a single degree of pivotable adjustment of the caliper 23 against post 33. Clamps 47, 48 and 50 use parts which are generally available from manufacturers of drumsets. The clamps include two disks which connect in an overlapping fashion to form a metal disc. On the mating surface of these disks are teeth or a friction surface, which prevents rotation when the clamps are tightened.

The combination of the various positioning rods 33–39 and attachment hardware 43–50 permit the caliper 23 to be positioned at an optimum position with respect to the cymbal disk 12. The rods 33–39 and attachment hardware 43–50 thereby cooperate with the support post 41 to position the caliper mechanism 23 at a preferred position with respect to the cymbal 11. Adjustment is made at the various mounts and clamps.

While a particular set of mounts are shown, the mounting may be achieved by any of a wide variety of clamps or like supporting members, which are commonly available from musician supply sources. The purpose of the mounting is to attach the brake caliper mechanism 23 so that, when the brake caliper mechanism 23 is actuated, the brake caliper mechanism 23 engages the cymbal. The brake caliper mechanism 23 is therefore attached to the positioning means whether it be connected directly to the support post 41 for the cymbal disk 12 alternately as a self-supporting independently mounted stand positioned on the floor or other supporting surface, While the damper assembly is described, it is also possible to operate and damp the cymbal 11 in any convenient manner.

Figure 3:
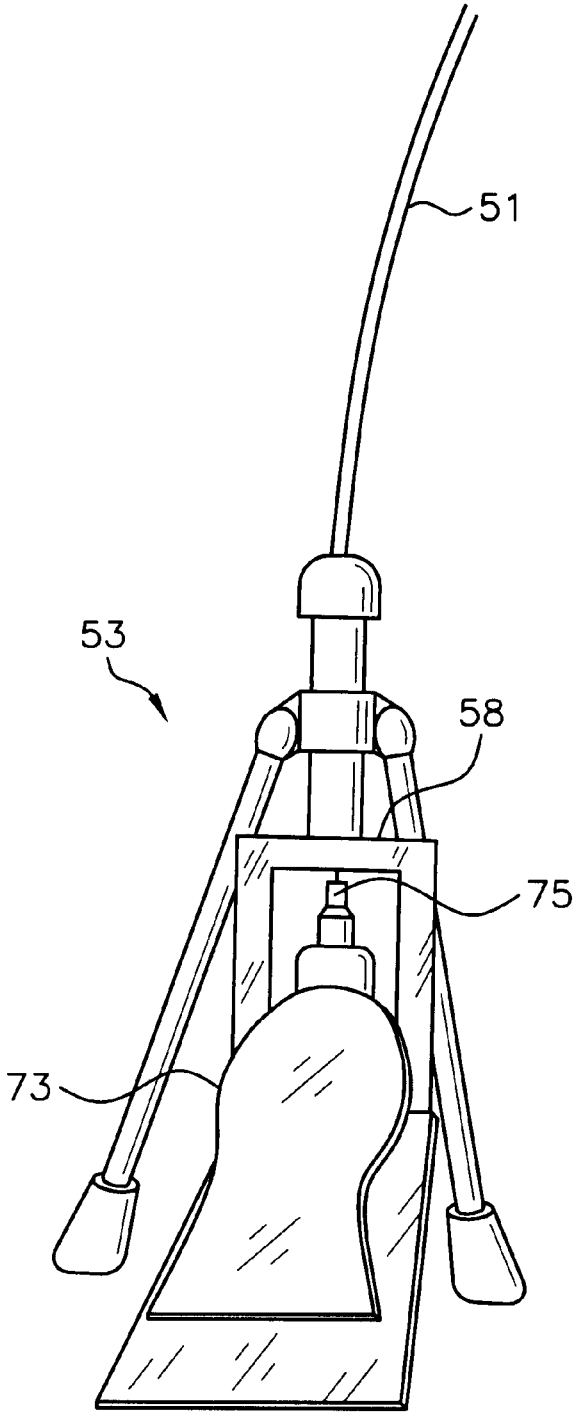
FIG. 3 is a front view of a foot pedal actuator which may be used with the present invention.

FIG. 3 is a front view of a foot pedal actuator 60 which may be used with the present invention. The operation of the foot pedal actuator can be understood by referring to the operation of the cable, shown in FIGS. 1–3. The cable 27 passes through cable cover 51 and is connected to a pedal assembly 53, shown on FIG. 3. Referring to FIGS. 1–3, the cable cover 51 maintains a fixed length of the cable between cable positioners 57, 58 located, respectively, on the brake caliper mechanism 23 and the pedal assembly 53. As is well known to cyclists, the cable cover 51 does more than cover the cable 27. The cable cover provides almost no compressibility and so becomes part of the mechanism for actuation of a component by cable. This actuation is achieved by maintaining a fixed length between cable ends, and hence a fixed cable length between cable stops. Adjustment of the cable is achieved by adjusting the relative distance between one of the cable stops and the attachment of the cable itself. In the case of the instant invention, the component being actuated is the caliper mechanism 23.

As can be seen in FIG. 2, in the case of a side pull arrangement, a free end 61 of the cable 27 is supported on one movable portion 65 of the brake caliper mechanism 23, while the cable cover 51 is retained on another movable portion 66 of the brake caliper mechanism 23. In the case of a side pull caliper 23, movable portion 66 includes cable positioner 57. In the case of a center pull arrangement, a separately mounted cable positioner (not shown) is used to retain the cable cover 51 on the brake caliper mechanism 23.

The configuration of the caliper mechanism 23 allows for actuation by the cable in a manner which is conventional for bicycle caliper brakes from which the brake caliper mechanism 23 is adapted. Musicians conventionally do not have bicycle handbrake levers attached to their drumsets, and so it is necessary to provide a form of actuation for the caliper mechanism 23, and hence the pedal assembly 53 is used.

Referring to FIG. 3, a pedal 73 is mounted as part of the pedal assembly 53. The pedal assembly 53 includes cable positioner 58 to limit travel of the cable cover 51, and a cable attach point 75. The cable positioner 58 is typically mounted above the pedal 73 so that downward movement of the pedal 73 increases the distance between the pedal 73 and the cable positioner 58.

The pedal assembly 71 may be purpose designed for operating a cable, such as one available from Yamaha, or may be a modification of any pedal assembly, such as for a drum pedal.

Figure 4:
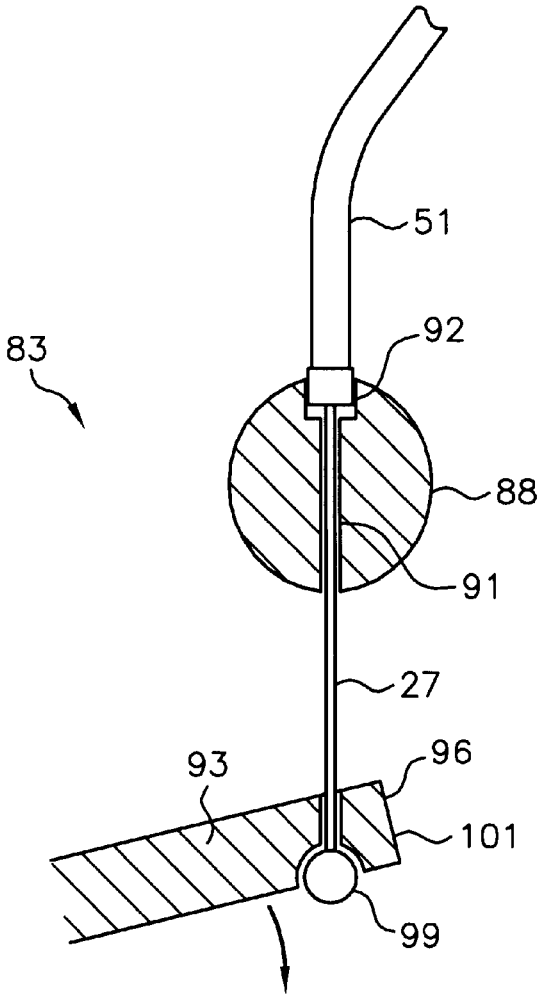
FIG. 4 is a cross-sectional drawing showing details of the cable end mount for the foot pedal actuator of FIG. 3.
Figure 5:
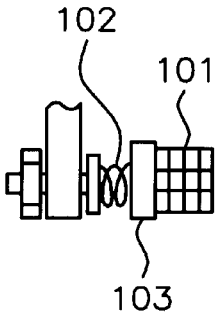
FIG. 5 is a drawing of a damper block using felt.

FIG. 4 shows such a modified pedal assembly 83. A cable positioner 88 is formed from a top support for the pedal assembly 83. A cable through hole 91 is drilled through the positioner 88. The cable positioner 88 thereby forms an end stop for the cable cover 51, but a blind hole 92 may be provided to seat the cable cover 51, thus maintaining lateral alignment of the cable cover 51 and reducing wear of the cable 27 and the positioner 88.

A pedal 93 has a slot 96 cut in the end to allow passage of the cable 27. In conventional bicycle brake cables, a cable end block 99 is formed at one end of the cable 27 and is intended to be received by the brake lever. This cable end block is typically made of a metal such as lead or aluminum having a melting point lower than that of the cable 27 and forms a part of a purchased bicycle cable 27. A blind hole 101 is drilled into the bottom of the slot 96 and prevents the cable 27 from slipping out of the slot 96 so long as there is tension on the cable 27. It is anticipated that the caliper mechanism 23 will exert tension on the cable 27.

It is alternatively possible to provide a through bore through the pedal 93 in a manner which will prevent the cable from escaping the pedal.

The cable positioner 58 or 88 blocks movement of a cable cover and allows the cable to pass through to an anchor on the pedal 73 or 93. In that manner, the cable 27 is actuated by pressing down on the pedal 73 or 93, and instead of a chain or rod being pulled, the cable 27 is pulled.

The free end of the cable 27 is at the caliper mechanism 23, as is the case with bicycle calipers. Coarse adjustments of the cable length are made by cutting the cable 27 and clamping the cable 27 to the caliper mechanism 23.

Since the caliper mechanism 23 is operated by the pedal 73 or 93, it is possible to operate multiple caliper mechanisms in the same manner. This can be accomplished with multiple pedals, but if the musician decides that one pedal can be used to dampen all of a selected group of cymbals, this can be accomplished by connecting all cables to a single pedal. Separate damping could still be accomplished by hand, in the traditional manner.

In one embodiment, the customary brake blocks used with the brake caliper are replaced with felt pads 101. The felt pads 101 are optionally mounted on mounting springs, such as spring 102, or on a resilient cushion 103. This provides the musician with a wide range of damping, as controlled by foot position and as varied by compression of the mounting spring and compression of the felt. The force is therefore proportional to the degree of compression of the felt 101, along with the spring 102 and or resilient cushion 103. This allows the pressure applied to the cymbal to be controlled by travel of the pedal 73 or 93. The back pressure on the pedal 73 or 93 is controlled by the spring action of the caliper mechanism 23, spring action, if any, of the pedal 73 or 93 and the positioning of the cable's attach points on the caliper mechanism 23 and pedal 73 or 93. If the pad 101 and its support are resilient, the effect on backpressure felt through the pedal 73 or 93 will be less significant than the spring action of the pedal 73 or 93 and caliper mechanism 23.

When a brake caliper mechanism is put to its intended use on a bicycle, braking force is controlled by back pressure applied through the reaction force of the pads against clamping. That is because the force is considerable, as used to apply sufficient pressure to cause sufficient friction to be developed. The spring action of the caliper mechanism 23 is merely to provide a return action for the calipers, transferred to the bicycle's handbrake levers. In the case of the present invention, it is anticipated that the back pressure will be significantly less. In the case of fully dampening the cymbal 11, it is only necessary that the pedal 73 or 93 be depressed; however if partial dampening is required, the musician is able to partially depress the pedal to achieve the partial dampening effect.

It is possible to modify the damper assembly in order to further enhance the cymbal. In one modification, a pair of small cymbals, called jingles, are mounted to the caliper. Alternatively, small bells being may be fastened to the caliper. Depending on the forces applied to the caliper, the jingles or bells will resonate. It is also possible to provide additional spring biasing against the pedal 73, 93 or provide a clamping mechanism to lock the caliper mechanism 23 against the cymbal disk 12. Since the damper assembly 21 is mounted to supporting brackets such as the positioning post 33, swivel mount 35, vertical support 36, horizontal support 38, and post clamp 39, it is possible to mount the damper assembly 21 so that the caliper mechanism 23 engages a single disk of a high hat cymbal, or if desired both disks. In the case of the caliper mechanism 23 mounted to engage a single disk, it is possible to move the mechanism 23 out of position or otherwise avoid blocking the use of the high hat cymbals' pedal operation.

What is claimed is:

1. A damper assembly for a cymbal structure, said damper assembly comprising:

mounting assembly able to be placed in a fixed relationship to the cymbal structure;

a caliper mechanism of a type used as a bicycle rim brake connected to said mounting means and disposed adjacent the cymbal so as to engage the cymbal upon actuation of the caliper mechanism;

a foot operable positioning means connected by a cable to the caliper mechanism;

at least one felt pad located at a brake block position on the caliper mechanism; and at least one resonant tambourine jingle mounted to the caliper mechanism.

2. A damper assembly for a percussion instrument, the damper assembly comprising:

a caliper mechanism of a type and general design used for bicycle rim brakes, the caliper mechanism positionable adjacent the percussion instrument in a manner to engage a sound producing portion of the percussion instrument upon actuation;

a foot pedal;

a cable and cable cover connecting the foot pedal to the caliper, the cable and cable cover connected so as to result in activation of the caliper mechanism in response to movement of the foot pedal;

at least one felt pad located at a brake block position on the caliper mechanism; and at least one resonant tambourine jingle mounted to the caliper mechanism.

3. A damper assembly for a percussion instrument, the damper assembly comprising:

a caliper mechanism of a type and general design used for bicycle rim brakes, the caliper mechanism positionable adjacent the percussion instrument in a manner to engage a sound producing portion of the percussion instrument upon actuation;

a foot pedal;

a cable and cable cover connecting the foot pedal to the caliper, the cable and cable cover connected so as to result in activation of the caliper mechanism in response to movement of the foot pedal;

a mounting arrangement to provide support for the caliper mechanism in its position, the mounting arrangement including a plurality of connecting rods connecting the caliper mechanism to a floor support and a plurality of clamps positionally fixing the connecting rods;

at least one of the clamps providing at least one degree of freedom in a pivotal adjustment; and at least one of the clamps providing at least two degrees of freedom in a pivotal adjustment: and further comprising at least one felt pad located at a brake block position on the caliper mechanism; and at least one resonant tambourine jingle mounted to the caliper mechanism.

* * * * *